US008511085B2

(12) United States Patent
Frey et al.

(10) Patent No.: US 8,511,085 B2
(45) Date of Patent: Aug. 20, 2013

(54) DIRECT EVAPORATOR APPARATUS AND ENERGY RECOVERY SYSTEM

(75) Inventors: Thomas Johannes Frey, Bavaria (DE); Matthew Alexander Lehar, Munich (DE)

(73) Assignee: General Electric Company, Niskayuna, NY (US)

( * ) Notice: Subject to any disclaimer, the term of this patent is extended or adjusted under 35 U.S.C. 154(b) by 939 days.

(21) Appl. No.: 12/624,636

(22) Filed: Nov. 24, 2009

(65) Prior Publication Data

US 2011/0120129 A1 May 26, 2011

(51) Int. Cl.
*F01K 25/08* (2006.01)

(52) U.S. Cl.
USPC ..... 60/651; 60/671

(58) Field of Classification Search
USPC ..... 60/671, 670, 614, 616, 618, 651, 60/39.182
See application file for complete search history.

(56) References Cited

U.S. PATENT DOCUMENTS

| | | | | |
|---|---|---|---|---|
| 5,437,157 | A | 8/1995 | Bronicki | |
| 5,555,731 | A | 9/1996 | Rosenblatt | |
| 5,638,773 | A * | 6/1997 | Brady et al. | 122/248 |
| 6,167,706 | B1 | 1/2001 | Bronicki et al. | |
| 6,539,718 | B2 | 4/2003 | Bronicki et al. | |
| 6,823,668 | B2 * | 11/2004 | Endoh et al. | 60/320 |
| 8,181,463 | B2 * | 5/2012 | Batscha et al. | 60/653 |
| 2008/0028931 | A1 | 2/2008 | Coda et al. | |

OTHER PUBLICATIONS

Hank Leibowitz and Daniel N. Schochet ; "Generating Electric Power From Compressor Station Residual Heat"; Downloaded from Internet:<http://www.oildom.com/PGJ/pgjarchive/Nov01/generating.pdf; 2 Pages.

* cited by examiner

*Primary Examiner* — Hoang Nguyen
(74) *Attorney, Agent, or Firm* — Andrew J. Caruso

(57) ABSTRACT

In one aspect, the present invention provides a direct evaporator apparatus for use in an organic Rankine cycle energy recovery system, comprising: (a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet. The direct evaporator apparatus is configured such that at least a portion of a heat source gas having contacted at least a portion of the heat exchange tube is in thermal contact with heat source gas entering the direct evaporator apparatus via the heat source gas inlet. An organic Rankine cycle energy recovery system and a method of energy recovery are also provided.

24 Claims, 2 Drawing Sheets

DIRECT EVAPORATOR APPARATUS AND ENERGY RECOVERY SYSTEM

BACKGROUND

The invention relates generally to an organic Rankine cycle energy recovery system, and more particularly to a direct evaporator apparatus and method for energy recovery employing the same.

So called "waste heat" generated by a large number of human activities represents a valuable and often underutilized resource. Sources of waste heat include hot combustion exhaust gases of various types including flue gas. Industrial turbomachinery such as turbines frequently create large amounts of recoverable waste heat in the form of hot gaseous exhaust streams.

Organic Rankine cycle energy recovery systems have been deployed as retrofits for small- and medium-scale gas turbines, to capture waste heat from the turbine's hot gas stream and convert the heat recovered into desirable power output. In an organic Rankine cycle, heat is transmitted to an organic fluid, typically called the working fluid, in a closed loop. The working fluid is heated by thermal contact with the waste heat and is vaporized and then expanded through a work extraction device such as a turbine during which expansion kinetic energy is transferred from the expanding gaseous working fluid to the moving components of the turbine. Mechanical energy is generated thereby which can be converted into electrical energy, for example. The gaseous working fluid having transferred a portion of its energy content to the turbine is then condensed into a liquid state and returned to the heating stages of the closed loop for reuse. A working fluid used in such organic Rankine cycles is typically a hydrocarbon which is a liquid under ambient conditions. As such, the working fluid is subject to degradation at high temperature. For example, at 500° C., a temperature typical of a hot heat source gas from a turbine exhaust stream, even highly stable hydrocarbons begin to degrade. Worse yet, a hydrocarbon working fluid useful in an organic Rankine cycle energy recovery system may begin degrade at temperatures far lower than 500° C. Thus, the use of an organic Rankine cycle energy recovery system to recover waste heat from a gas turbine system is faced with the dilemma that the temperature of the exhaust is too high to bring into direct thermal contact with the working fluid of the organic Rankine cycle energy recovery system.

In order to avoid the aforementioned issue, an intermediate thermal fluid system is generally used to convey heat from the exhaust to an organic Rankine cycle boiler. In an example, intermediate thermal fluid system is an oil-filled coil which moderates the temperature of the working fluid in the organic Rankine cycle boiler. However, the intermediate thermal fluid system can represent significant portion of the total cost of an organic Rankine cycle energy recovery system. Furthermore, the intermediate thermal fluid system both increases the complexity of the organic Rankine cycle energy recovery system and represents an additional component the presence of which lowers the overall efficiency of thermal energy recovery.

Therefore, an improved organic Rankine cycle system is desirable to address one or more of the aforementioned issues.

BRIEF DESCRIPTION

In one aspect, the present invention provides a direct evaporator apparatus for use in an organic Rankine cycle energy recovery system, comprising: (a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet. The direct evaporator apparatus is configured such that at least a portion of a heat source gas having contacted at least a portion of the heat exchange tube is in thermal contact with heat source gas entering the direct evaporator apparatus via the heat source gas inlet.

In another aspect, the present invention provides a direct evaporator apparatus for use in an organic Rankine cycle energy recovery system, comprising: (a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankin cycle working fluid, the heat exchange tube comprising a working fluid inlet and a working fluid outlet. The heat source gas inlet and the heat source gas outlet are configured such that at least a portion of a heat source gas exiting the heat source gas outlet is in thermal contact with a heat source gas entering the direct evaporator apparatus via the heat source gas inlet.

In yet another aspect, the present invention provides an organic Rankine cycle energy recovery system comprising: (i) a direct evaporator apparatus comprising: (a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet; (ii) a work extraction device; (iii) a condenser; and (iv) a pump. The direct evaporator apparatus is configured such that at least a portion of a heat source gas having contacted at least a portion of the heat exchange tube is in thermal contact with heat source gas entering the direct evaporator apparatus via the heat source gas inlet. The direct evaporator apparatus, work extraction device, condenser and pump are configured to operate as a closed loop.

In yet another aspect, the present invention provides a method of energy recovery comprising: (a) introducing a heat source gas having a temperature into a direct evaporator apparatus containing a liquid working fluid; (b) transferring heat from the heat source gas having a temperature T1 to the working fluid to produce a superheated gaseous working fluid and a heat source gas having temperature T2; (c) expanding the superheated gaseous working fluid having a temperature T3 through an work extraction device to produce mechanical energy and a gaseous working fluid having a temperature T4; (d) condensing the gaseous working fluid to provide a liquid state working fluid; and (e) returning the liquid state working fluid to the direct evaporator apparatus; wherein steps (a)-(e) are carried out in a closed loop. The direct evaporator apparatus comprises (i) a housing comprising a heat source gas inlet, and a heat source gas outlet, the housing defining a heat source gas flow path from the inlet to the outlet; and (ii) a heat exchange tube disposed within the heat source gas flow path, the heat exchange tube being configured to accommodate an organic Rankine cycle working fluid, the heat exchange tube comprising a working fluid inlet and a working fluid outlet; and wherein the direct evaporator apparatus is configured such that at least a portion of a heat source gas having contacted at least a portion of the heat exchange tube is in thermal contact with heat source gas entering the direct evaporator apparatus via the heat source gas inlet.

BRIEF DESCRIPTION OF THE DRAWING FIGURES

These and other features, aspects, and advantages of the present invention will become better understood when the following detailed description is read with reference to the accompanying drawings in which like characters represent like parts throughout the drawings, wherein.

DETAILED DESCRIPTION

In the following specification and the claims, which follow, reference will be made to a number of terms, which shall be defined to have the following meanings.

The singular forms "a", "an" and "the" include plural referents unless the context clearly dictates otherwise.

"Optional" or "optionally" means that the subsequently described event or circumstance may or may not occur, and that the description includes instances where the event occurs and instances where it does not.

It is also understood that terms such as "top," "bottom," "outward," "inward," and the like are words of convenience and are not to be construed as limiting terms. Furthermore, whenever a particular feature of the invention is said to comprise or consist of at least one of a number of elements of a group and combinations thereof, it is understood that the feature may comprise or consist of any of the elements of the group, either individually or in combination with any of the other elements of that group.

Approximating language, as used herein throughout the specification and claims, may be applied to modify any quantitative representation that could permissibly vary without resulting in a change in the basic function to which it is related. Accordingly, a value modified by a term or terms, such as "about", is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term.

As noted, in one embodiment the present invention provides a direct evaporator apparatus for use in an organic Rankine cycle energy recovery system, comprising: (a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet. The direct evaporator apparatus is configured such that at least a portion of a heat source gas having contacted at least a portion of the heat exchange tube is in thermal contact with heat source gas entering the direct evaporator apparatus via the heat source gas inlet.

Figure 1:
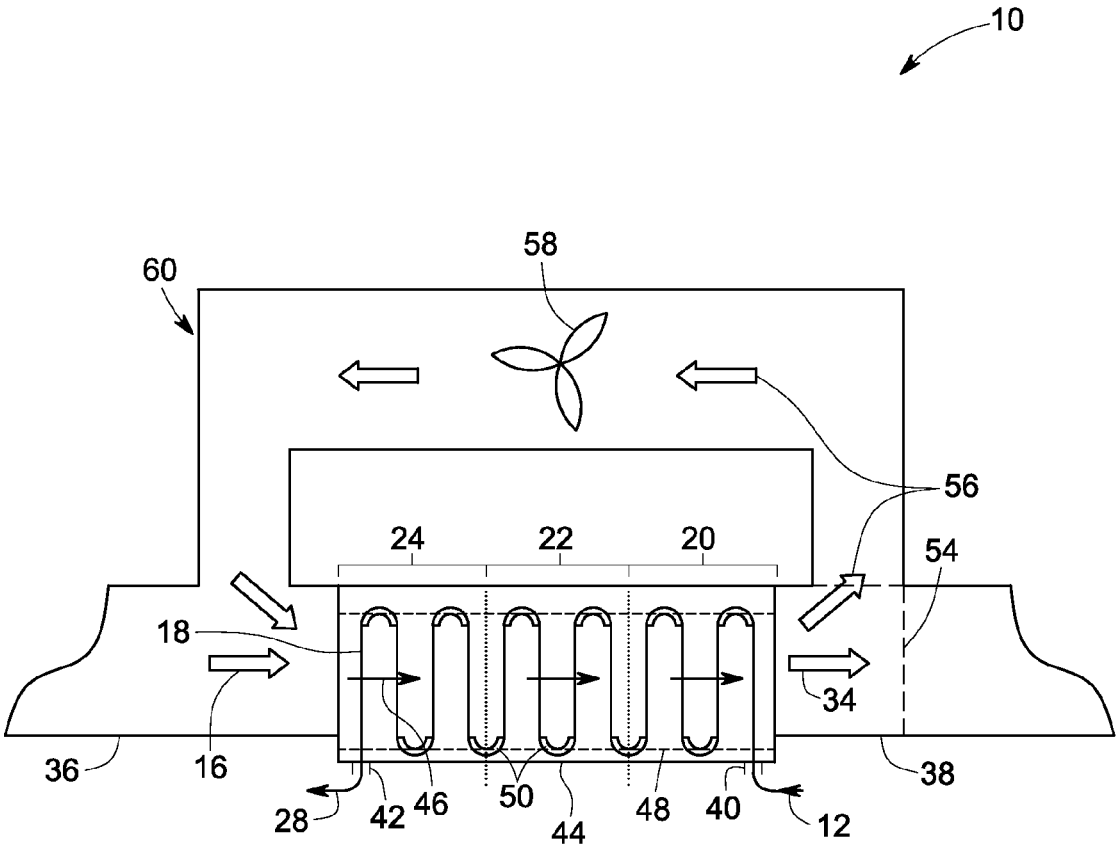
FIG. 1 is a schematic illustration of a direct evaporator apparatus in accordance with an embodiment of the invention.

The FIG. 1. is a schematic illustration of direct evaporator apparatus 10. The direct evaporator apparatus 10 shown in FIG. 1 is coupled to a heat source 14 (not shown) that serves as a source of heat source gas 16. The direct evaporator apparatus includes a housing 44 that includes a heat source gas inlet 36, and a heat source gas outlet 38. The housing defines a heat source gas flow path from said inlet to said outlet. A heat exchange tube 18 is disposed the heat source gas flow path 46. The heat source gas flow path 46 is essentially the entire interior of the direct evaporator apparatus defined by the housing wall 48 and space within the interior of the direct evaporator apparatus not occupied by the heat exchange tube 18.

In one embodiment, the heat exchange tube 18 is disposed entirely within the heat source gas flow path 46. As used herein the term "disposed entirely within the heat source gas flow path" means that the heat exchange tube is disposed entirely within the housing of the direct evaporator apparatus such that during operation, a working fluid traverses the exterior wall of the housing only twice; once as the working fluid enters the direct evaporator apparatus via the working fluid inlet 40 and once as the working fluid exits the direct evaporator apparatus via the working fluid outlet 42. In the embodiment illustrated in FIG. 1 the heat exchange tube 18 is shown as being secured within the direct evaporator apparatus housing 44 by embedding portions 50 of the heat exchange tube 18 within the housing wall 48. An alternate, but equivalent way of expressing this embodiment is that that the heat exchange tube 18 is disposed entirely within the housing 44 of the direct evaporator apparatus 10 such that during operation, a working fluid 12 traverses the exterior wall of the housing 44 only twice; once as the working fluid enters the direct evaporator apparatus via the working fluid inlet 40 and once as the working fluid exits the direct evaporator apparatus via the working fluid outlet 42. With the exception of heat exchange tube portions 50, the heat exchange tube 18 lies within heat source gas flow path 46.

The heat exchange tube is configured to accommodate an organic Rankine cycle working fluid 12. As noted, in the embodiment shown in FIG. 1, the direct evaporator apparatus 10 coupled to a heat source which is configured to provide a heat source gas 16 that enters the direct evaporator apparatus via heat source gas inlet 36 and contacts the heat exchange tube along the heat source gas flow path 46 to facilitate heat exchange between the working fluid 12 and the heat source gas 16 in a manner that does not overheat the working fluid 12. The heat exchange tube includes a working fluid inlet 40 and a working fluid outlet 42. The working fluid travels along a working fluid flow path defined by the heat exchange tube 18. In one embodiment, during operation, the working fluid enters and exits the housing only twice; once as the working fluid enters the direct evaporator apparatus via the working fluid inlet 40 and once as the working fluid exits the direct evaporator apparatus via the working fluid outlet 42.

In the embodiment illustrated in FIG. 1, the portions 50 of the heat exchange tube embedded within the housing wall lie outside of the heat source gas flow path but remain entirely within the housing 44 of the direct evaporator apparatus 10.

The heat exchange tube defines three zones, a first zone 20 adjacent to the heat source gas outlet, a second zone 22 and a third zone 24. In one embodiment, the second zone is adjacent to said heat source gas inlet, and the third zone is disposed, with respect to the heat source gas flow path, between the first zone and the second zone. In another embodiment, the third zone is adjacent to said heat source gas inlet, and the second zone is disposed, with respect to the heat source gas flow path, between the first zone and the third zone. Zone 20 is referred to as the "first zone" for the purposes of this discussion because it is in direct fluid communication with the working fluid inlet. Zone 22 is referred to as the "second zone" for the purposes of this discussion because it is in direct fluid communication with the first zone 20. Zone 24 is referred to as the "third zone" for the purposes of this discussion because it is in direct fluid communication with the second zone 22. The term "direct fluid communication" as used herein means that there is no intervening zone between components of the direct evaporator apparatus. Thus, there is direct fluid communication between the working fluid inlet 40 and the first zone 20, direct fluid communication between the first zone 20 and the second zone 22, direct fluid communication between the second zone 22 and the third zone 24, and direct fluid communication between the third zone 24 and the working fluid outlet 42.

In one embodiment, the zone 24 is said to be between zone 22 and zone 20 since a heat source gas 16 entering the direct evaporator apparatus at heat source gas inlet 36 first contacts zone 22 of the heat exchange tube 18, and must contact zone 24 of the heat exchange tube before contacting zone 20 of the heat exchange tube. In one embodiment, the first zone 20 is not in direct fluid communication with said third zone 24. In one embodiment, the heat exchange tube includes a plurality of bends in each of the first zone, second zone and third zone. In one embodiment, the heat exchange tube 18 is configured in parallel rows in each of the first zone, second zone and third zone. In one embodiment, each of the first zone, second zone and third zone of the heat exchange tube is configured in at least one row.

Working fluid in the liquid state enters the first zone 20 of the direct evaporator apparatus via working fluid inlet 40 where it is preheated as it moves towards zone 22 of the heat exchange tube. Thus second zone 22 receives an inflow of the working fluid 12 from the first zone 20 and vaporizes the working fluid 12.

In one embodiment, the second zone 22 is configured such that the heat source gas 16 from the heat source 14 entering the direct evaporator apparatus via the heat source gas inlet 36 contacts that portion of the heat exchange tube constituting zone 22, and heat exchange occurs between the heat source gas 16 and the working fluid sufficient to vaporize the working fluid. Various operating factors such as the flow rate of the working fluid into the direct evaporator apparatus and the size of the heat exchange tube can be used to control the temperature of the working fluid inside the various zones of the heat exchange tube such that overheating and degradation of the working fluid may be avoided. In one embodiment, the temperature of vaporized working fluid exiting zone 22 can be maintained at a temperature a range from about 150° C. to about 300° C. In one embodiment, the temperature of the vaporized working fluid exiting the second zone 22 is about 230° C.

As noted, the heat source gas 16 enters the direct evaporator apparatus at heat source gas inlet 36 and is hottest at the heat source gas inlet. In one embodiment, the heat source gas entering the direct evaporator apparatus at the heat source gas inlet is at a temperature in a range between about 350° C. and about 600° C. In an alternate embodiment, the heat source gas entering the direct evaporator apparatus at the heat source gas inlet is at a temperature in a range between about 400° C. and about 500° C. In yet another embodiment, the heat source gas entering the direct evaporator apparatus at the heat source gas inlet is at a temperature in a range between about 450° C. and about 500° C. In one embodiment, the heat source gas first contacts zone 24 also referred to as superheater zone, and cools as the heat is transferred from the heat source gas to the portion of the heat exchange tube constituting zone 24. In another embodiment, the heat source gas first contacts zone 22, sometimes referred to as the evaporation zone, and cools as heat is transferred from the heat source gas to the portion of the heat exchange tube constituting zone 22.

The heat source gas 34 exiting from the heat exchange tubes comes in contact with an internal structure 54 at the heat source gas outlet 38. In one embodiment, the internal structure is placed adjacent to the heat source gas outlet. The internal structure directs the heat source gas 34 exiting from the heat source gas outlet to a return loop 60. The internal structure may be a baffle, flow channel, or splitter vane. In one embodiment, the internal structure is baffle that is adjustable to control a flow of the heat source gas exiting the direct evaporator apparatus. The diverted heat source gas 56 after coming in contact with the internal structure 54 comes in thermal contact with the incoming heat source gas 16 prior to entering at heat source gas inlet 36. As used herein the term "thermal contact" refers to either intimate mixing of the diverted heat source gas and the incoming heat source gas or contact of the diverted heat source gas and the incoming heat source gas across a barrier. The barrier is a heat-transmissive barrier capable of transferring heat from the diverted heat source gas to the incoming heat source gas. In one embodiment, the heat-transmissive barrier is an oil-filled heat exchange loop. In another embodiment, the heat-transmissible barrier is an array of tube channels or compartments separated by flat plates, in each case with or without fins. In one embodiment, shown in FIG. 1, the diverted heat source gas 56 may be contacted with a fan 58 in the return loop 60. The return loop 60 connects the heat source gas outlet with the heat source gas inlet. In one embodiment, the direct evaporator apparatus is configured such that there is a thermal contact between the heat source gas within the direct evaporator apparatus and the heat source gas entering the direct evaporator apparatus. In another embodiment, the direct evaporator apparatus is configured such that there is a thermal contact between the heat source gas exiting the direct evaporator apparatus and the heat source gas entering the direct evaporator apparatus In one embodiment, the temperature of the mixture of heat source gas and diverted heat source gas is in a range between about 250° C. and about 600° C. In another embodiment, the temperature of the mixture of heat source gas the diverted heat source gas is in a range of about 300° C. and about 450° C. In yet another embodiment, the temperature of the mixture of heat source gas the diverted heat source gas is in a range of about 300° C. and about 400° C.

Figure 2:
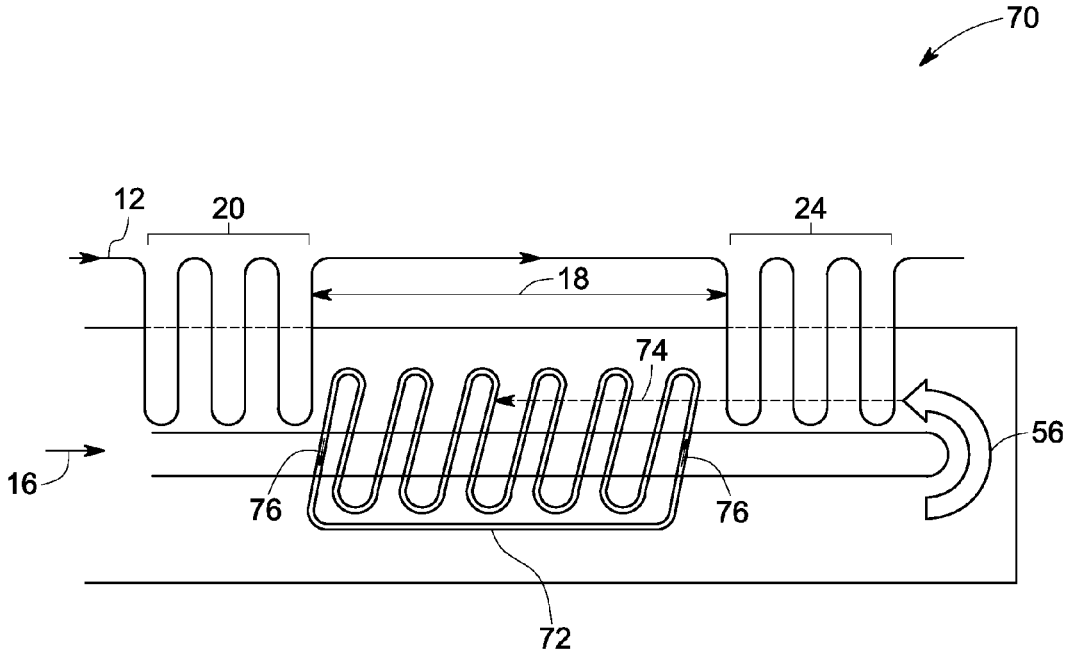
FIG. 2 is a schematic illustration of a direct evaporator apparatus in accordance with an embodiment of the invention.

FIG. 2 is a schematic illustration of a direct evaporator apparatus 70 in accordance with one embodiment of the invention. The direct evaporator apparatus 70 shown is FIG. 2 may be coupled to a heat source that serves as a source for the heat source gas 16. A heat exchange tube 18 is disposed entirely within the heat source gas flow path 46. The heat exchange tube is configured to accommodate an organic Rankine cycle working fluid 12 and the working fluid travels along a working fluid flow path defined by the heat exchange tube 18. The heat exchange tube 18 defines three zones, a first zone 20 (a preheater zone) adjacent to the heat source gas outlet, a second zone 22 (an evaporation zone, not shown) adjacent to said heat source gas inlet, and a third zone 24 (superheater zone) disposed between the first zone and the second zone.

During operation the direct evaporator apparatus illustrated in FIG. 2 the heat source gas 16 entering the direct evaporator apparatus first encounters the second zone (22). Heat from the heat source gas 16 is transferred to the working fluid 12 present in the second zone, the heat transferred being sufficient to evaporate at least a portion of the working fluid 12 present in the second zone. In one embodiment, the heat source gas having a relatively lower temperature and heat content than the heat source gas entering the direct evaporator apparatus next encounters the third zone 24 in which the working fluid is superheated and superheated working fluid exits the direct evaporator apparatus. In one embodiment, the heat source gas after encounter with the second zone is contacted with a heat-transmissive barrier 72 comprising a closed oil loop. The circulation of oil 76 in the heat-transmissive barrier comprising the closed oil loop may be pump driven or buoyancy driven. In one embodiment, the oil 76 in the heat-transmissive barrier 72 can flow parallel to the heat source gas flow path. In another embodiment, the oil 76 in the heat-transmissive barrier 72 can have a counter flow to the heat source gas flow path. The heat source gas after contact with the heat-transmissive barrier has temperature in a range between about 300° C. and about 400° C. In one embodiment, the diverted heat source gas 56 comes in thermal contact with the heat source gas after contact with the second zone 22 of the direct evaporator apparatus.

Figure 3:
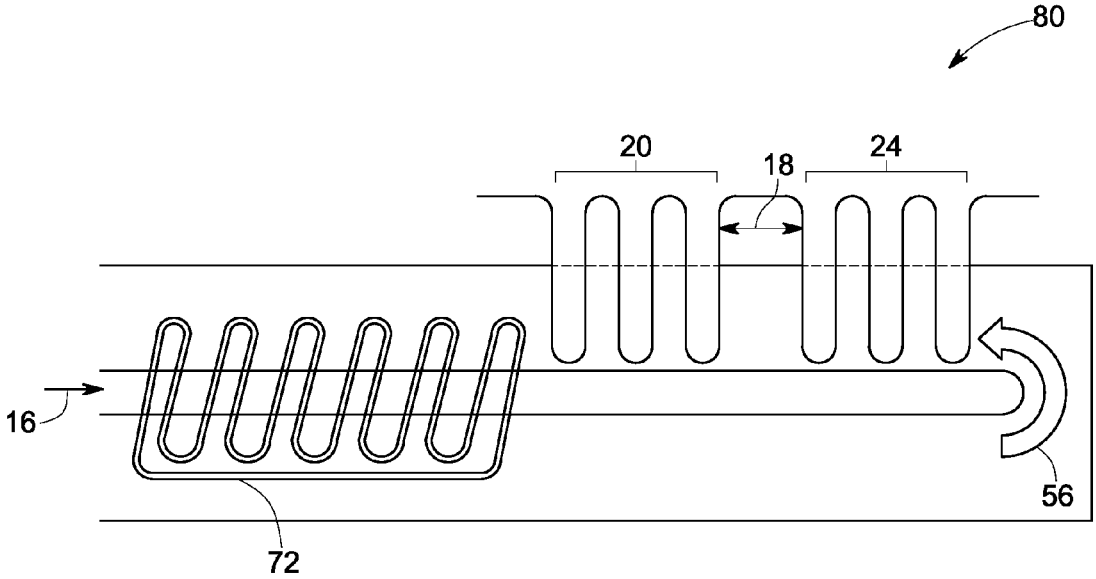
FIG. 3 is a schematic illustration of a direct evaporator apparatus in accordance with an embodiment of the invention.

FIG. 3 is a schematic illustration of a direct evaporator apparatus 80 in accordance with one embodiment of the invention. Heat from the heat source gas 16 is transferred to the working fluid 12 present in the second zone, the heat transferred being sufficient to evaporate at least a portion of the working fluid 12 present in the second zone. In one embodiment, the heat source gas having a relatively lower temperature and heat content than the heat source gas entering the direct evaporator apparatus next encounters the second zone 22 where the heat transferred being sufficient to evaporate at least a portion of the working fluid 12 present in the second zone. In one embodiment, as shown in FIG. 3 the heat-transmissive barrier 72 is placed in the heat source gas flow path after contact with the second zone of the direct evaporator apparatus and before contact with the second zone 22 of the direct evaporator apparatus. Therefore, while in operation the heat source gas prior to encountering the second zone 22, comes in thermal contact with the diverted heat source gas 56 across a heat-transmissive barrier 72 wherein heat exchange may occur. In one embodiment, the heat-transmissive barrier is a closed oil loop.

As noted, the working fluid 12 may in one embodiment, be a hydrocarbon. Non-limiting examples of hydrocarbons include cyclopentane, n-pentane, methylcyclobutane, isopentane, methylcyclopentane propane, butane, n-hexane, and cyclohexane. In another embodiment, the working fluid can be a mixture of two or more hydrocarbons. In one embodiment, the working fluid is a binary fluid such as for example cyclohexane-propane, cyclohexane-butane, cyclopentane-butane, or cyclopentane-cyclohexane mixtures. In yet another embodiment, the working fluid is a hydrocarbon is selected from the group consisting of methylcyclobutane, cyclopentane, isopentane, cyclohexane, and methycyclopentane.

In various embodiments of the invention, the heat source may be any heat source which may be used to produce a gas stream susceptible to introduction into the direct evaporator apparatus via the heat source gas inlet. In one embodiment, the heat source is a gas turbine, the exhaust from which may be used as the heat source gas. Other heat sources include exhaust gases from residential, commercial, and industrial heat sources such as home clothes dryers, air conditioning units, refrigeration units, and gas streams produced during fuel combustion, for example flue gas. In one embodiment, geothermal heat is employed as the heat source.

In one embodiment, a method of energy recovery is provided. The method includes (a) introducing a heat source gas having a temperature into a direct evaporator apparatus containing a liquid working fluid; (b) transferring heat from the heat source gas having a temperature T1 to the working fluid to produce a superheated gaseous working fluid and a heat source gas having temperature T2; (c) expanding the superheated gaseous working fluid having a temperature T3 through a work extraction device to produce mechanical energy and a gaseous working fluid having a temperature T4; (d) condensing the gaseous working fluid to provide a liquid state working fluid; and (e) returning the liquid state working fluid to the direct evaporator apparatus. In one embodiment, the heat source gas has a temperature T1 in a range from about 350° C. to about 600° C. In another embodiment, the heat source gas has a temperature T1 in a range from about 400° C. to about 550° C. In one embodiment, the heat source gas has a temperature T2 in a range from about 70° C. to about 200° C. In another embodiment, the superheated gaseous working fluid has a temperature T3 in a range from about 200° C. to about 300° C. In one embodiment, the working fluid in the first zone is at a temperature in a range from about 0° C. to about 150° C. In another embodiment, the working fluid in the second zone is at a temperature in a range from about 100° C. to about 300° C. In yet another embodiment, the working fluid in the third zone is at a temperature in a range from about 150° C. to about 300° C.

In one embodiment, the present invention provides an organic Rankine cycle energy recovery system. The organic Rankine cycle energy recovery system includes an organic Rankine cycle system comprising a direct evaporator apparatus as configured in FIG. 1. The direct evaporator apparatus may be coupled to a heat source, for example an exhaust unit of a heat generation system (for example, an engine). The direct evaporator apparatus receives heat from the heat source gas or exhaust gas generated from the heat source and generates a working fluid vapor. In one embodiment, the working fluid vapor may be passed through an expander (for example an axial type expander, an impulse type expander, a high temperature screw type expander and the like) to drive a work extraction device for example a generator unit. In one embodiment, the work extraction device is a turbine. In one embodiment, the turbine is configured to produce electrical energy. In one embodiment, the energy recovery system may include a turbine by-pass duct. After passing through the expander, the first working fluid vapor at a relatively lower pressure and lower temperature may be passed through a recuperator, which may function as a heat exchange unit. The working fluid vapor is condensed into a liquid using a condenser, which is then pumped via a pump to the direct evaporator apparatus. The direct evaporator apparatus, work extraction device, condenser and pump are configured to operate as a closed loop. The cycle may then be repeated.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A direct evaporator apparatus for use in an organic Rankine cycle (orc) energy recovery system, comprising:

(a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet;

wherein the direct evaporator apparatus is configured such that at least a portion of a heat source gas having contacted at least a portion of the heat exchange tube is in thermal contact with a heat source gas entering the direct evaporator apparatus via the heat source gas inlet.

2. The direct evaporator apparatus according to claim 1, configured such that the thermal contact is between the heat source gas exiting the direct evaporator apparatus and the heat source gas entering the direct evaporator apparatus.

3. The direct evaporator apparatus according to claim 1, configured such that the thermal contact is between the heat source gas within the direct evaporator apparatus and the heat source gas entering the direct evaporator apparatus.

4. The direct evaporator apparatus according to claim 1, further comprising a baffle and a return loop connecting the heat source gas outlet with the heat source gas inlet.

5. The direct evaporator apparatus according to claim 4, wherein the baffle is adjustable to control a flow of the heat source gas exiting the direct evaporator apparatus and which passes through the return loop and is brought into thermal contact with the heat source gas entering the direct evaporator apparatus.

6. A direct evaporator apparatus for use in an organic Rankine cycle energy recovery system, comprising:

(a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet;

wherein the heat source gas inlet and the heat source gas outlet are configured such that at least a portion of a heat source gas exiting the heat source gas outlet is in thermal contact with a heat source gas entering the direct evaporator apparatus via the heat source gas inlet.

7. The direct evaporator apparatus according to claim 6, wherein the heat exchange tube defines three zones, a first zone adjacent to the heat source gas outlet, a second zone adjacent to the heat source gas inlet, and a third zone disposed between the first zone and the second zone, the working fluid inlet being in direct fluid communication with the first zone, and the working fluid outlet being in direct fluid communication with the third zone; and wherein the first zone is not in direct fluid communication with the third zone.

8. The direct evaporator apparatus according to claim 6, wherein the heat exchange tube is disposed entirely with the heat source gas flow path.

9. The direct evaporator apparatus according to claim 6, wherein the heat exchange tube defines three zones, a first zone adjacent to the heat source gas outlet, a second zone disposed between the first zone and a third zone, said third zone being adjacent to the heat source gas inlet, the working fluid inlet being in direct fluid communication with the first zone, and the working fluid outlet being in direct fluid communication with the third zone.

10. The direct evaporator apparatus according to claim 6, configured such that the thermal contact takes place across a barrier.

11. The direct evaporator apparatus according to claim 10, wherein the barrier is a heat-transmissive barrier.

12. The direct evaporator apparatus according to claim 7, further comprising a baffle and a return loop connecting the heat source gas outlet with the heat source gas inlet.

13. The direct evaporator apparatus according to claim 12, wherein the baffle is adjustable to control a flow of the heat source gas exiting the direct evaporator apparatus and which passes through the return loop and is brought into thermal contact with the heat source gas entering the direct evaporator apparatus.

14. An organic Rankine cycle energy recovery system comprising:

(i) a direct evaporator apparatus comprising:

(a) a housing comprising a heat source gas inlet, and a heat source gas outlet, the housing defining a heat source gas flow path from the inlet to the outlet; and (b) a heat exchange tube disposed within the heat source flow path, the heat exchange tube being configured to accommodate an organic Rankine cycle working fluid, the heat exchange tube comprising a working fluid inlet and a working fluid outlet;

wherein the direct evaporator apparatus is configured such that at least a portion of a heat source gas having contacted at least a portion of the heat exchange tube is in thermal contact with a heat source gas entering the direct evaporator apparatus via the heat source gas inlet;

(ii) a work extraction device;

(iii) a condenser; and (iv) a pump;

wherein the direct evaporator apparatus, work extraction device, condenser and pump are configured to operate as a closed loop.

15. The energy recovery system according to claim 14, wherein the work extraction device comprises a turbine.

16. The energy recovery system according to claim 15, wherein said turbine is configured to produce electrical energy.

17. A method of energy recovery comprising:

(a) introducing a heat source gas having a temperature into a direct evaporator apparatus containing a liquid working fluid;

(b) transferring heat from the heat source gas having a temperature T1 to the working fluid to produce a superheated gaseous working fluid and a heat source gas having temperature T2;

(c) expanding the superheated gaseous working fluid having a temperature T3 through a work extraction device to produce mechanical energy and a gaseous working fluid having a temperature T4;

(d) condensing the gaseous working fluid to provide a liquid state working fluid; and (e) returning the liquid state working fluid to the direct evaporator apparatus;

wherein steps (a)-(e) are carried out in a closed loop; and wherein the direct evaporator apparatus comprises (i) a housing comprising a heat source gas inlet, and a heat source gas outlet, the housing defining a heat source gas flow path from the inlet to the outlet; and (ii) a heat exchange tube disposed within the heat source gas flow path, the heat exchange tube being configured to accommodate an organic Rankine cycle working fluid, the heat exchange tube comprising a working fluid inlet and a working fluid outlet;

wherein the direct evaporator apparatus is configured such that at least a portion of a heat source gas having contacted at least a portion of the heat exchange tube is in thermal contact with a heat source gas entering the direct evaporator apparatus via the heat source gas inlet.

18. The method according to claim 17, wherein the working fluid is a hydrocarbon.

19. The method according to claim 18, wherein the working fluid is selected from the group consisting of methylcyclopentane, methylcyclobutane, cyclopentane, isopentane, and cyclohexane.

20. The method according to claim 17, wherein the temperature of the heat source gas entering the direct evaporator apparatus is in a range from about 350° C. to about 600° C.

21. The method according to claim 17, wherein the heat source gas is air.

22. The method according to claim 17, wherein the heat source gas is flue gas.

23. The method according to claim 17, wherein the heat source gas has a temperature T2 in a range from about 100° C. to about 250° C.

24. The method according to claim 17, wherein the thermal contact is intimate mixing.

* * * * *